United States Patent [19]

Schwarz et al.

[11] Patent Number: 4,852,857

[45] Date of Patent: Aug. 1, 1989

[54] PROTECTIVE DEVICE FOR SUBMERSIBLE LANCE IN STEEL MAKING OR THE LIKE

[75] Inventors: Wilhelm Schwarz, Hilchenbach; Winfried Heinz, Schortens, both of Fed. Rep. of Germany

[73] Assignee: Fried. Krupp Gesellschaft Mit Beschrankter, Essen, Fed. Rep. of Germany

[21] Appl. No.: 261,584

[22] Filed: Oct. 21, 1988

[30] Foreign Application Priority Data

Oct. 28, 1987 [DE] Fed. Rep. of Germany ..... 3736495

[51] Int. Cl.[4] ..... C21D 11/00

[52] U.S. Cl. ..... 266/99; 266/88; 266/225; 266/270

[58] Field of Search ..... 266/87, 88, 99, 225, 266/270

[56] References Cited

U.S. PATENT DOCUMENTS 3,763,704 10/1973 Blau et al. ..... 266/99

FOREIGN PATENT DOCUMENTS 0143498 6/1985 European Pat. Off. .

*Primary Examiner*—Robert McDowell

*Attorney, Agent, or Firm*—Herbert Dubno

[57] ABSTRACT

A protective device for a submersible lance to be used in a vessel of molten material, such as steel, prevents undesirable deposition of the material at the juncture of lance and probe by having in the lance a channel for gas, and by having between the lance and the probe a gas-conducting disk which projects this gas circumferentially onto the lower surface of the lance.

8 Claims, 4 Drawing Sheets

PROTECTIVE DEVICE FOR SUBMERSIBLE LANCE IN STEEL MAKING OR THE LIKE

FIELD OF THE INVENTION

Our present invention relates to a device for protection of a submersible control device for use in a melting vessel. In particular, the invention relates to a device for preventing the harmful deposition of material onto the juncture between the lance and an attached probe which holds the control device.

BACKGROUND OF THE INVENTION

Certain control devices for melting vessels, such as steel melting vessels, consist mainly of a lance along with a probe which has a sensor and sampling section at the lower end of the probe held on by means of a pasteboard or cardboard tube which is attached to the lance by means of a connecting tube. The uppermost annular face of the pasteboard or cardboard tube fits against a juncture surface of the lance. Within the pasteboard or cardboard tube there is an electrical connector with contacts which are connected to a mating piece on the connecting tube when the probe is put on.

During the operation of such a device, especially in steel convertors, deposits form on the lance and on the juncture surface of the pasteboard or cardboard tube. Both slag and steel deposits are involved, and hereinafter both types are generically referred to as deposits. These deposits originate because of splashes resulting from the bubbling of gases in the converter. The lower surface of the lance can be additionally fouled by deposits which occur because of initially-liquid deposits which flow downward from the casing of the measuring lance and which then solidify to form a collar of deposits The result of such deposits at the juncture is that after a number of insertions of the lance into the converter for the taking of measurements, because of the buildup of deposits associated therewith, it becomes difficult to attach new probes. The length tolerance in the coupling is exceeded, with the result that reliable electrical contacts can no longer be achieved, rather, interruptions and short circuits occur. Moreover, deposits can form on the connecting tube itself, especially at its opening into the lance, which leads to additional mechanical difficulties. The extra thermal protection offered by the pasteboard tube to the connecting tube can also be partly lost, resulting in damage to the connecting tube.

To avoid these operational difficulties in the apparatus caused by such deposit formation, these deposits must be removed on a routine maintenance basis as well as when special need arises. This work has to be carried out in a dangerous environment with exposure to dust and heat, and it increases the operating expense of the plant.

To avoid these collar-like deposits, in accordance with European Patent Application No. 0143498, the use of elastic rings between the lance and the probe has been proposed. However, the use of such rings in actual practice entails serious difficulties.

OBJECTS OF THE INVENTION

It is a principal object of the present invention to avoid these difficulties and to provide a reliable and long-lasting means for avoiding undesirable deposits at the juncture of the lance and probe. It is a further object to provide a convenient and easily constructed device for avoiding such deposits.

SUMMARY OF THE INVENTION

These and other objects of the invention are achieved in a device for the prevention of deposits in the region of the juncture between the lance and the probe of a control device to be inserted into molten material in a vessel.

These objects are accomplished in accordance with the invention by providing that the lance has an interior channel leading to the juncture, and at the juncture, located concentrically between the lance and the probe, a gas-conducting disk is provided which projects around its circumference a gas stream so that this stream is projected onto the lower surface of the lance at the juncture. Thus the invention utilizes the principle of a "hard" gas stream, the kinetic energy of the gas stream being directed against the slag and steel splashes so as to deflect their flight away from the critical region, in this case, the juncture of lance and probe.

Also, that portion of the steel and slag which runs down from the lance cover and which clings in the liquid state to the lance, is flung off from the lance by the force of the gas stream. The gas-conducting disk, which serves as an annular jet discharge nozzle, is located tangentially and immediately upon the upper surface of the lower end of the lance. In the region of the outlet of the stream of gas, there is for the most part no flow-limiting layer, so that any particles that continue to flow down despite the effect of the gas stream are immediately flung off. The vent stream forms a flow-constraining layer, which however always remains turbulent.

The gas-conducting disk preferably consists of a material which is not capable of welding with the molten material. For this purpose, copper and copper alloys, graphite, and ceramics are appropriate, since they will not weld with steel, and the first two of these are also highly effective in preventing or hindering the adhesion of slag.

It is also advantageous for the gas-conducting disk to be bonded directly onto the lance. The gas-conducting disk can also be an integral part of the tube connecting the probe with the lance.

The gas-conducting disk is fed from the interior channel of the connecting tube through several radial openings. By forming the connecting tube so that it is able to be screwed on by use of a retaining nut, by which means the main part of the connecting tube does not have to be turned, there is an annular gap between the main part and the turnable nut, this gap serving to produce an equal apportionment of the gas flow.

In a further feature of the invention, the gas-conducting disk is an annular plate having crossbars mounted on it forming radial channels. Alternatively, the gas-conducting disk may be made up of two annular plates having crossbars between them forming radial channels. In this embodiment, the flow cross sections are rectangular. By sharpening the crossbars at the inlet end, Laval jets are formed by means of which a high stream velocity can be achieved at the outlet. A further improvement in the efficacy of the gas stream can be achieved if the crossbars are bent to form sickle-shaped channels.

Furthermore, an advantageous feature of the invention is that in which the lower surface of the lance extending beyond the gas flow disk is curved upward.

While in the region of sharp bending of the lower surface of the lance, the gas stream follows the contour, until the stream reaches a region where it is no longer needed for its protective action against deposits.

In another advantageous feature of the invention, the gas is supplied at the entrance to the radial channels at a pressure of at least 2.6 bar and is adjusted to such a rate that in the narrowest cross-section of the radial channels the gas velocity reaches Mach 1.

As the gas for use in the invention, compressed air, nitrogen, argon, and helium, or mixtures thereof are suitable.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
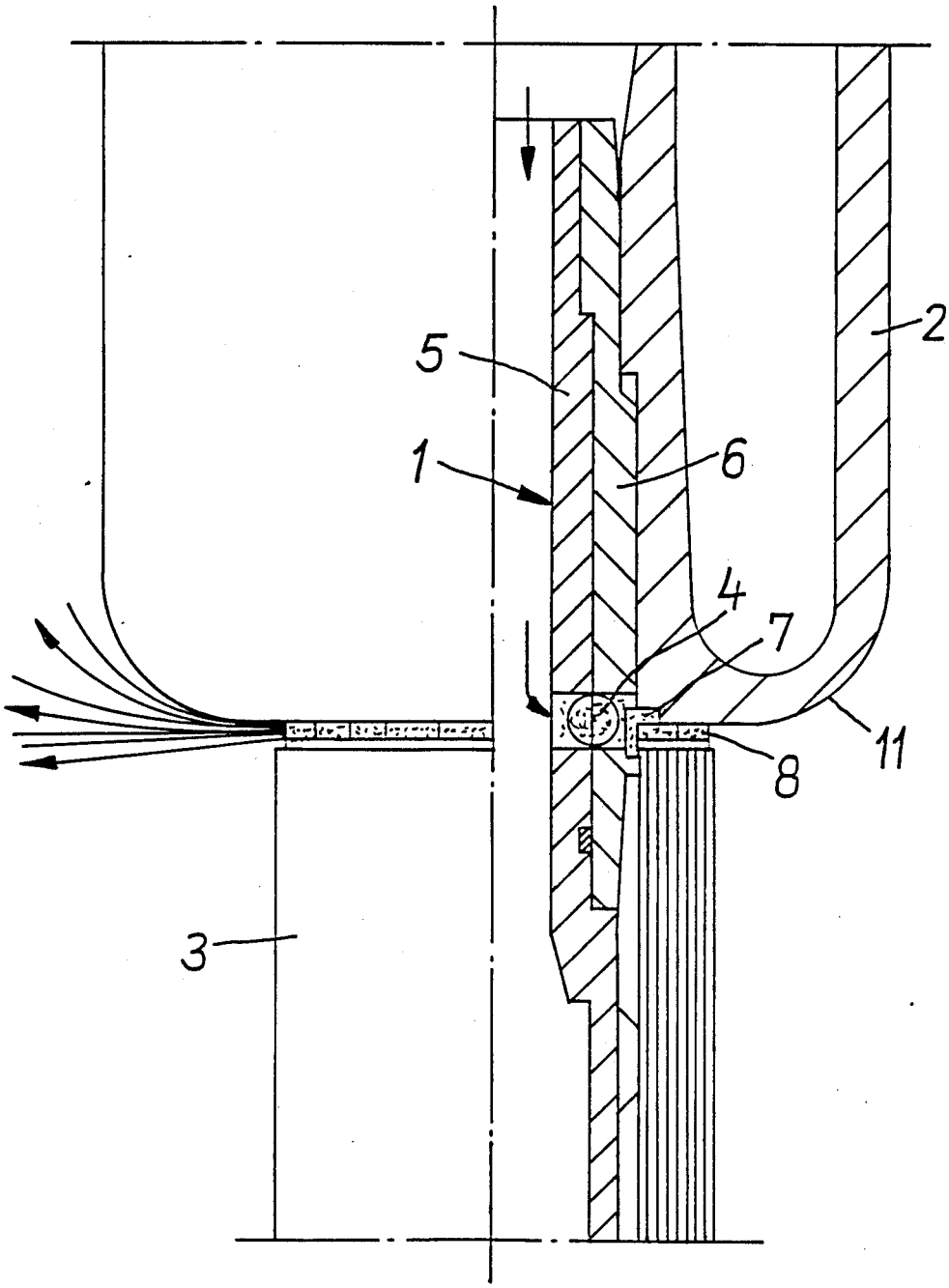
FIG. 1 is a schematic representation of a juncture between the lance and the probe.
Figure 2:
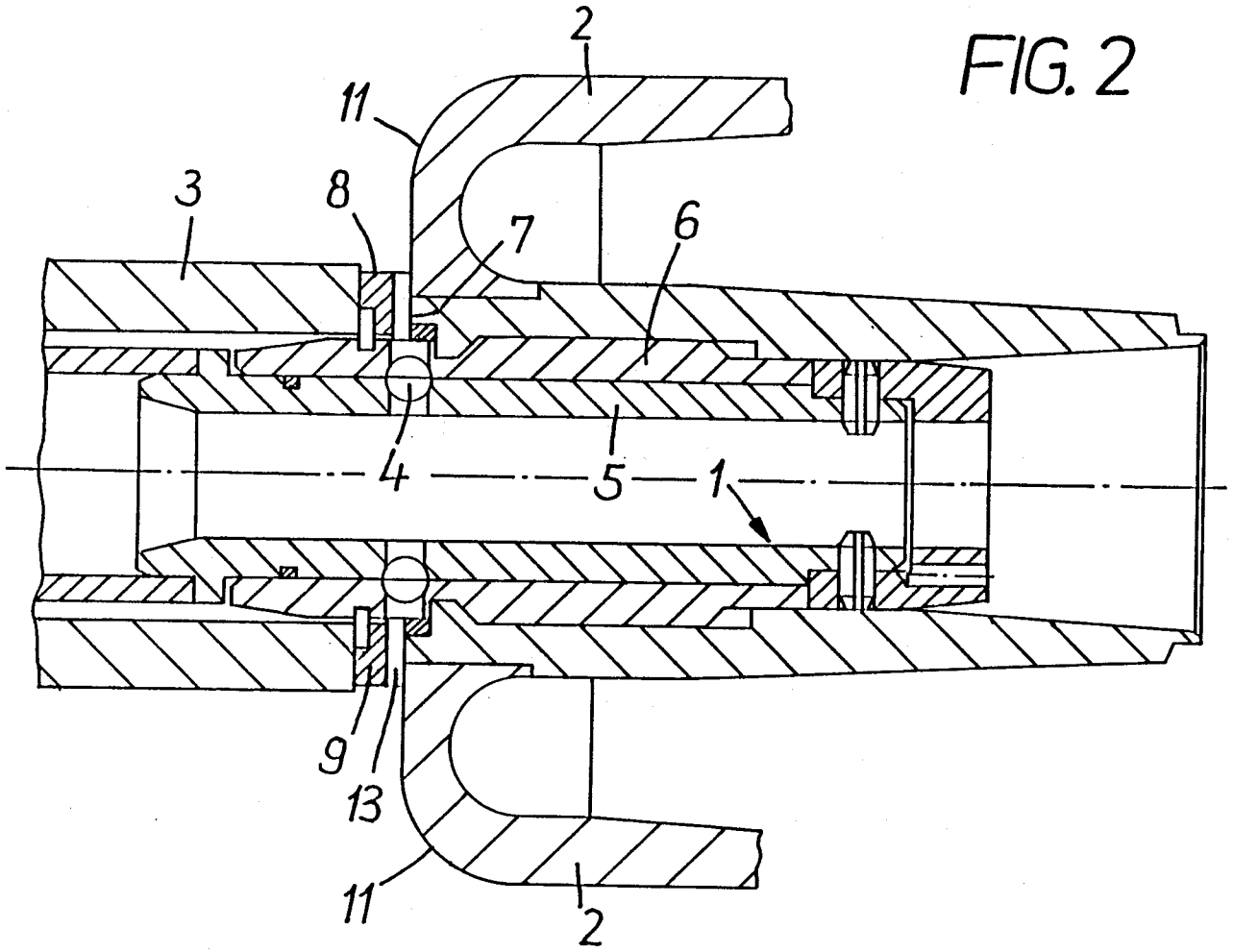
FIG. 2 is a view of a lengthwise section through another embodiment of such a juncture.

As shown in FIG. 1, a connecting tube 1 links the lance 2 and the probe 3 to a melting vessel control device.

By way of the interior space of the lance 2 and the connecting tube 1, a gas is conducted under pressure, this gas entering an annular opening 4 between the inner part 5 and the outer part 6 of the connecting tube 1.

Figure 3:
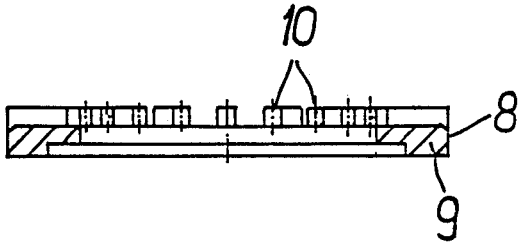
FIG. 3 and FIG. 4 respectively, are views in cross-section and from above of a gas-conducting disk having, on one side, crossbars mounted on a flat annular surface.

The gas proceeds therefrom by way of a annular opening 7 into a gas-conducting disk 8. As shown in FIG. 3, the gas-conducting disk 8 consists of an annular plate 9 with crossbars 10 mounted on it, the upper surface of this plate 8 being held apposite the lower surface 11 of the lance 2.

Figure 4:
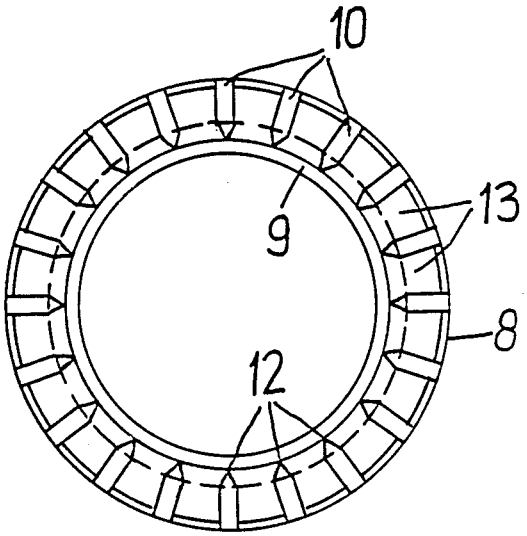

As shown in FIGS. 3 and 4, the crossbars 10 have their radially innermost ends provided with angular bevels and they form distribution channels 13 with a shape of the Laval jet type.

Figure 5:
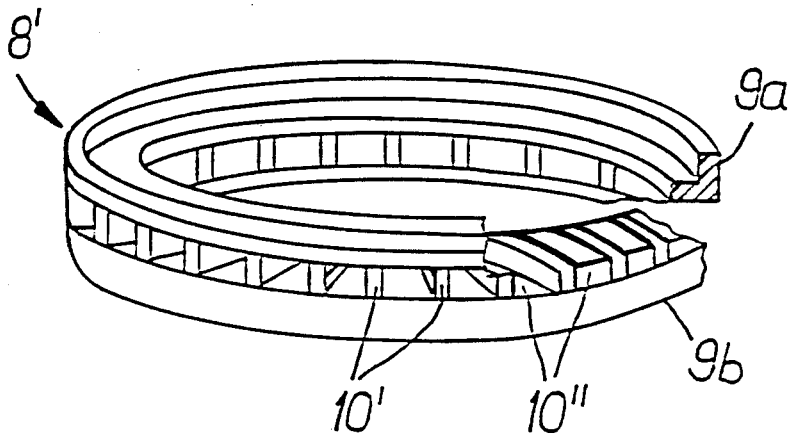
FIG. 5 is a perspective view, partly broken away, of another embodiment of the disk.

The gas exits from the distribution channels 13 in an annular stream is projected with substantial velocity onto the entire lower surface 11 of the lance 2, so that, during active use of the control device, this lower surface is protected from the formation of deposits FIG. 5 shows a gas guide disk 8' which can be used as described for the disk 8, which is composed of two annular plates **9*a* and 9*a* with the ribs 10' are curved to form generally sickle-shaped channels 10''**.

We claim:

1. A device for the prevention of deposits in the region of the juncture between a lance and a probe of a control device to be inserted into molten material in a vessel, wherein said lance is provided with an interior channel for conducting a gas stream to said juncture, and at said juncture concentrically between said lance and said probe there is provided a gas-conducting disk which circumferentially projects said gas stream onto the lower surface of said lance at said juncture.

2. The device defined in claim 1 wherein said gas-conducting disk consists of a material which is resistant to becoming welded with the molten material.

3. The device defined in claim 1 wherein said gas-conducting disk is attached directly onto the lance.

4. The device defined in claim 1 wherein said lance and said probe are connected by a connecting tube and said gas-conducting disk is an integral part of said connecting tube.

5. The device defined in claim 1 wherein said gas-conducting disk comprises an annular plate having crossbars forming radial channels.

6. The device defined in claim 1 wherein said gas-conducting disk comprises two annular plates having crossbars between said plates forming radial channels.

7. The device defined in claim 6. wherein said crossbars are curved to form sickle-shaped channels.

8. The device defined in claim 1 wherein the lower surface of said lance extending beyond said gas-conducting disk is curved upward.

* * * * *